US005332093A

United States Patent [19]

Littlepage

[11] Patent Number: 5,332,093

[45] Date of Patent: Jul. 26, 1994

[54] MAILBOX SHAPED DOLL AND ACCESSORY CARRIER AND BLANK THEREFORE

[76] Inventor: Fred Littlepage, 8017 Langbrook Rd., Springfield, Va. 22152

[21] Appl. No.: 17,387

[22] Filed: Feb. 12, 1993

[51] Int. Cl.[5] ..... A45C 7/00; A45C 11/00

[52] U.S. Cl. ..... 206/457; 190/102; 190/107; 190/112; 383/4; 446/73; 446/80; 446/268

[58] Field of Search ..... 383/41, 66, 4; 190/102, 190/112-115, 107, 127; 224/121, 122; 446/72, 73, 80, 268; 206/457

[56] References Cited

U.S. PATENT DOCUMENTS

| | | | |
|---|---|---|---|
| D. 49,163 | 5/1915 | Sickels . | |
| D. 235,365 | 6/1975 | Gay et al. . | |
| D. 268,201 | 3/1983 | McElhaney . | |
| D. 283,747 | 5/1986 | Margiloff . | |
| D. 288,105 | 2/1987 | Hollingshead et al. . | |
| D. 289,427 | 5/1987 | Owens . | |
| D. 301,728 | 6/1989 | Garner . | |
| D. 313,106 | 12/1990 | Hoffman et al. . | |
| D. 323,230 | 1/1992 | Barrios . | |
| D. 324,444 | 3/1992 | Cummings . | |
| 2,175,319 | 10/1939 | Rubenstein | 206/457 X |
| 2,239,365 | 1/1940 | Loth . | |
| 2,278,124 | 10/1939 | Kowinski . | |
| 2,585,745 | 2/1952 | Crosby | 190/112 X |
| 3,173,465 | 3/1965 | Pastini | 190/107 X |
| 3,456,380 | 3/1969 | Cameron . | |
| 3,497,992 | 1/1968 | Balter . | |
| 3,586,349 | 3/1969 | Green et al. . | |
| 3,777,862 | 12/1973 | Zipper | 190/107 |
| 3,789,546 | 2/1974 | Morrison . | |
| 4,131,227 | 5/1977 | Patton et al. . | |
| 4,204,361 | 7/1978 | Chaput . | |
| 4,244,512 | 1/1981 | Wise . | |
| 4,318,471 | 3/1982 | Hutton . | |
| 4,544,051 | 10/1985 | Saltz | 190/127 X |
| 4,685,570 | 8/1987 | Medow . | |
| 4,802,575 | 2/1989 | Martin . | |
| 4,815,607 | 3/1989 | Agapiou . | |
| 4,842,133 | 6/1989 | LaBarge et al. | 190/102 X |
| 4,874,340 | 10/1989 | Smallwood | 446/72 X |
| 4,881,684 | 11/1989 | Chinman | 190/115 |
| 4,883,443 | 11/1989 | Chase . | |
| 4,911,670 | 3/1990 | McNicholas et al. . | |
| 4,984,906 | 1/1991 | Little | 383/4 |

FOREIGN PATENT DOCUMENTS

| | | | |
|---|---|---|---|
| 0000635 | of 1883 | United Kingdom | 190/112 |

*Primary Examiner*—Bryon P. Gehman

*Attorney, Agent, or Firm*—Sandler Greenblum & Bernstein

[57] ABSTRACT

A blank is provided which is adapted to be folded into a carrier for holding a doll and related accessories. The carrier is preferably formed from any desired fabric which is soft, lightweight and durable, and corrugated board inserts can be placed within panels forming the carrier in order to reinforce them and provide a desired strength. When assembled, each of the carriers of the present invention resembles a mailbox in appearance, with a first carrier including a pivotable flag, and with other carriers having simulated mail slots on their exterior surfaces. Additionally, retaining structure is provided for detachably retaining a doll, a writing implement and various writing accessories on the interior of the carrier.

20 Claims, 4 Drawing Sheets

FIG. 3
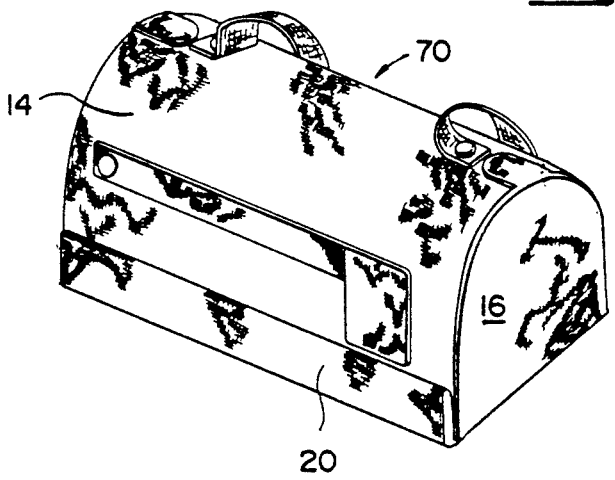
FIG. 11
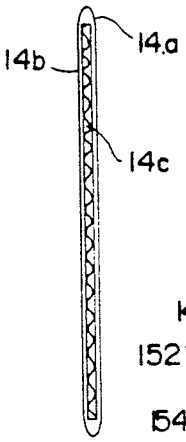
FIG. 4
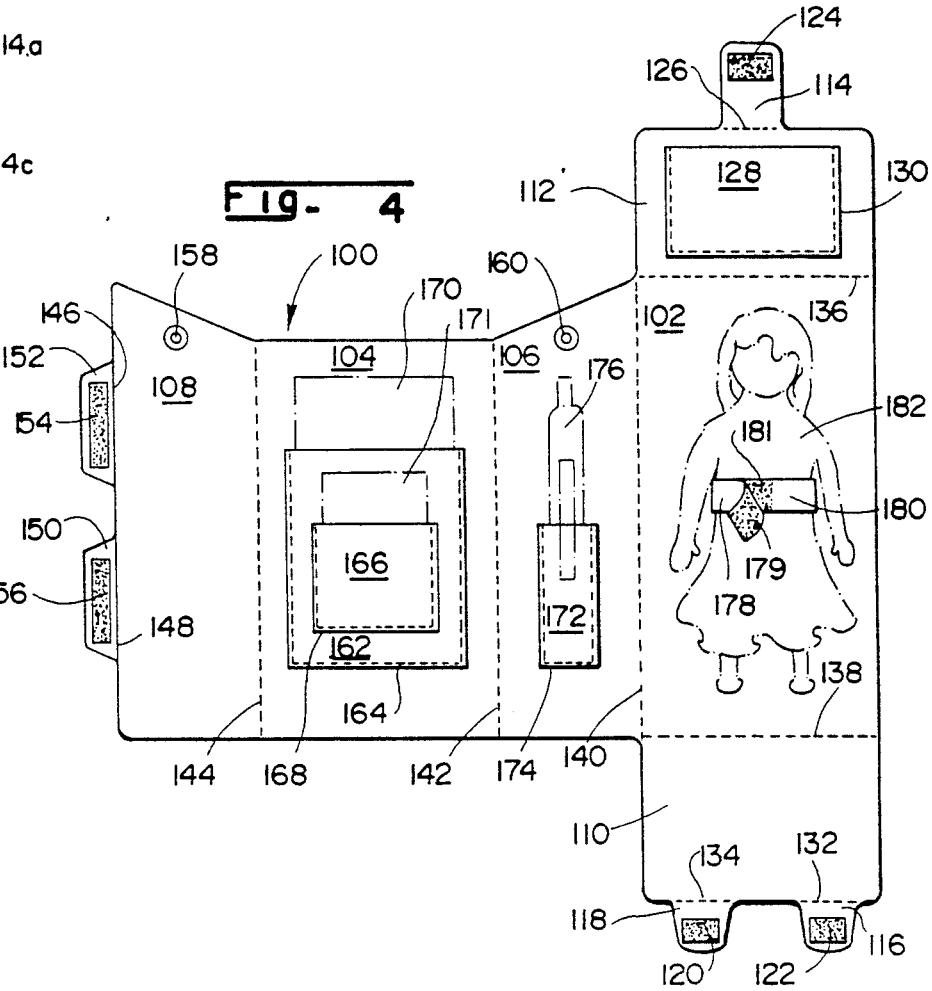
FIG. 12

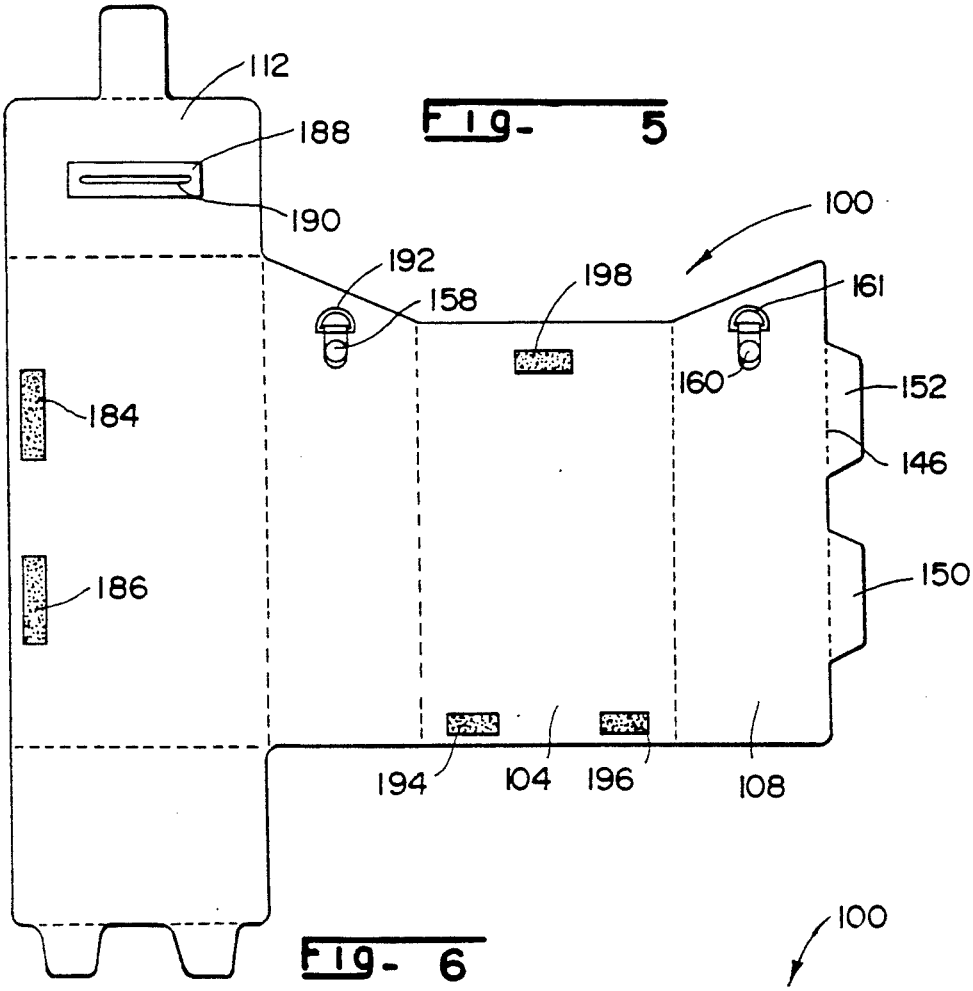
Fig- 5
Fig- 6
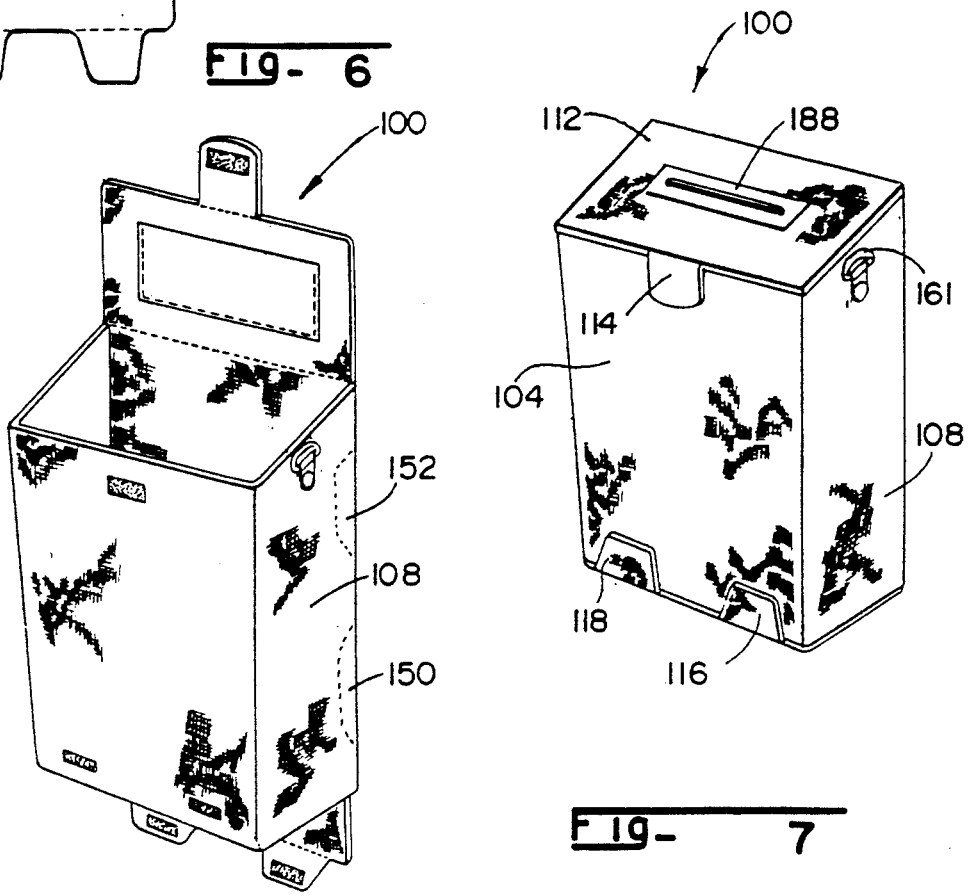
Fig- 7

MAILBOX SHAPED DOLL AND ACCESSORY CARRIER AND BLANK THEREFORE

BACKGROUND OF THE INVENTION

1. Related Applications

This application is related to a design patent application filed by the same applicant on even date herewith, entitled "Mailbox Shaped Carrier for Holding Dolls and Related Articles", the entire disclosure of which is expressly incorporated by reference herein.

2. Field of the Invention

The present invention is generally related to a carrier and a blank which is foldable to form the carrier, and more particularly to a doll and accessory carrier which can be formed from a blank into the shape of a simulated mailbox.

3. Background Information

There are a number of known containers which can hold dolls and doll accessories, or simulate other items when the containers are in use, to serve both functional and design purposes, namely to carry articles in a desired fashion, and to provide a unique and pleasing exterior appearance.

Examples of containers which are foldable to form cradles for dolls, e.g., include LOTH, U.S. Pat. Nos. 2,239,365 and KOWINSKI, 2,278,124. Each of these patents discloses a container which is foldable from a blank of material and which can be used as both a carrier and a toy cradle for dolls.

Other doll carriers are also known. For example, BALTER, U.S. Pat. No. 3,497,992, discloses a transparent plastic toy carrying case which can carry, e.g., a small doll, and which simulates the appearance of a padlock on its exterior. GAY et al., U.S. Design U.S. Pat. No. 235,365, discloses a carrying case which, when opened, can be used as a playhouse. GARNER, U.S. Design U.S. Pat. No. 301,728, apparently discloses a flexible carrier for dolls; and McNICHOLAS et al., U.S. Pat. No. 4,911,670, discloses an educational doll kit, which includes a flat doll body to which doll clothing can be removably attached, together with a carrying case and stand. GREEN et al., U.S. Pat. No. 3,586,349, discloses a doll package having a heart-shaped doll case which is capable of holding both a boy and girl doll as well as a book and other accessories.

Other containers and carrying cases provide an exterior appearance which simulates the appearance of another article of commerce when in use. For example, PATTON et al., U.S. Pat. No. 4,131,227, discloses a carrying case for audiovisual aids which is formed from cardboard and which presents the appearance of a house on its exterior surface. MCELHANEY, U.S. Design U.S. Pat. No. 268,201, discloses a combined toy building and carrying case which has a flexible exterior surface and which provides the appearance of a toy building and carrying case when assembled in carrier form.

None of these patents, however, provides a carrier for dolls and other accessories which includes a foldable blank, which when folded into assembled condition in which the blank serves as a carrier, simulates the external appearance of a mailbox. Nor do any of these containers provide a simple method of assembling and disassembling the walls of such a container, of retaining both the doll and a number of different accessories therein, and of easily removing such accessories.

SUMMARY OF THE INVENTION

Accordingly, it is one object of the present invention to provide a unique carrying case for an article of commerce and a plurality of accessories which can be formed from a single blank of material and which is easily assembled and disassembled to provide easy access to the articles retained within the container.

It is another object of the present invention to provide a carrying case for dolls and related accessories, which, when assembled, simulates the external appearance of a mailbox.

Still another object of the present invention is to provide a flexible and lightweight carrier for dolls and accessories which is easy to carry, and in which articles which are retained within the carrier are securely retained, yet easy to remove.

It is another object of the present invention to provide a container which can be easily folded from a single blank, wherein the articles retained in the container are not visible from the exterior of the container.

Still another object of the present invention is to provide a container which has the external appearance of a mailbox and which is adapted to retain a writing implement, stamps, a doll, and paper, so as to stimulate children into becoming pen pals with other purchasers of the container and its contents.

Accordingly, in accordance with a first aspect of the present invention, a blank is adapted to be folded into a carrier for at least one article, the blank comprising a base panel having first and second side edges and first and second end edges; means attached to the base panel for releasably retaining said at least one article on said base panel; at least one side panel foldably attached to one of said side edges of said base panel, said at least one side panel being adapted to be folded over said retaining means; a first end panel foldably attached to said first end edge of said base panel, and a second end panel foldably attached to said second end edge of said base panel; and a first closure tab attached to an edge of said first end panel, with a second closure tab attached to an edge of said second end panel. The at least one side panel comprises a single side panel having one side edge foldably connected to said first side edge of said base panel, and an opposed free side edge, the blank further comprising a second side panel having first and second side edges, said second side panel first side edge being foldably connected to said second side edge of said base panel, said side panels having complementary means for detachably connecting said side panels to each other when the blank is folded into a container.

Each of the end panels can include means for detachably connecting the end panels to an outer surface of the at least one side panel. The single side panel has an inner surface, with a plurality of article retaining pockets attached to said inner surface of said single side panel. Both the retaining means and connecting means can comprise Velcro.

All of the panels can comprise two layers of cloth stitched to each other; and reinforcing panels can be positioned between the layers of cloth within a plurality of said panels. The at least one side panel can comprise a plurality of side panels, including a first side panel foldably attached to the first side edge of the base panel, a second side panel foldably attached to the first side panel, and a third side panel foldably attached to the second side panel. Each of the end panels includes means for detachably connecting the end panels to the second side panel.

The blank can also have at least one article retaining pocket attached to the inner surfaces of a plurality of said side panels; and each of the end panels has an inner surface and an outer surface, wherein an article retaining pocket can be attached to an inner surface of at least one of the end panels. The at least one side panel comprises a plurality of side panels, including a first side panel having a first side foldably attached to the first side edge of the base panel, and a second side panel foldably attached to a second side edge of said first side panel. Each of said end panels includes means for detachably connecting said end panels to an inner surface of said first side panel, and each of the side panels has an outer surface and an inner surface, wherein at least one article retaining pocket is attached to an inner surface of each of said side panels, with the connecting means comprising Velcro.

In another aspect, the present invention further comprises a container in the shape of a mailbox, the container comprising a carrier for at least one article and comprising: a base having an outer surface and an inner surface; means for detachably retaining the at least one article on the inner surface of said base, said base having opposed first and second side edges and first and second end edges; a wall extending from said first side edge of said base to said second side edge of said base, said wall comprising a cover overlying said base panel and having open first and second ends; means for closing said open ends of said cover, said closing means comprising end panels adapted which are foldably connected to the base; and means for detachably connecting said wall to said end panels.

Each of said first and second end panels includes means for connecting said end panels to an outer surface of said wall, with the connecting means comprising a tab foldably connected to each end wall. The wall can comprise two sections, a first section attached to the first side edge of the base and comprising an arcuate cover overlying said base, the second section being foldably attached to the second side edge of said base, each of said wall sections including means for detachably connecting said wall sections to each other. Further, a generally L-shaped flag is pivotably attached to an outer surface of said wall, said flag having an elongated arm pivotably connected to said wall, and a perpendicular section attached to one end of said elongated arm. A carrying handle can also be attached to an outer surface of said wall. The retaining means comprises Velcro, and one of the end panels and the wall each includes at least one article retaining pocket respectively attached to inner surfaces of said wall and said one end panel.

The wall can also comprise three sections, a first section which is foldably connected to said first side edge of said base in generally perpendicular fashion, a second section which is foldably connected to said first section in a generally perpendicular position so as to overlie said base panel in generally parallel fashion, and a third section which is foldably connected to said second section and which is generally perpendicularly connected to both said base and said second section, said third section including means for detachably connecting said third section to an outer surface of said base. In addition, a generally rectangular piece of fabric is attached to the outer surface of one of said end walls of the container, the fabric having a central slot. Each of the first and third sections of the wall include means, attached to outer surfaces of said first and third sections, for attaching a handle to the container. The retaining means can comprise a Velcro loop attached to an inner surface of said base.

The three wall sections can comprise, e.g., a first section foldably connected to the first side edge of the base in generally perpendicular fashion, a second section foldably connected to the first section, and inclined downwardly from one side edge of the first section, and a third section foldably connected to the base in generally perpendicular fashion, with the second and third sections including means for detachably connecting these sections to each other. A generally rectangular piece of fabric can be attached to the outer surface of the second section, and has a central slot.

BRIEF DESCRIPTION OF THE DRAWINGS

The above and other objects, features and advantages of the present invention can be readily seen by reference to the attached drawings, in which like reference numerals represent similar parts throughout the several views, and wherein:

FIG. 3 is a perspective view of a container formed by folding the blank of FIG. 1;

FIG. 4 is a plan view of a blank formed in accordance with a second embodiment of the present invention, prior to folding, with the inner surface of the blank being visible;

FIG. 5 is a plan view of the blank of FIG. 4, shown with its outer surface visible;

FIG. 6 is a perspective view of the blank of FIG. 4, in partially assembled fashion;

FIG. 7 is a perspective view of a container formed by folding the blank of FIG. 4;

FIG. 11 is a cross section of the blank of FIG. 1, taken along line 11—11 of FIG. 1; and FIG. 12 is a cross sectional view of the blank of FIG. 1, taken along line 12—12 of FIG. 1.

DETAILED DESCRIPTION OF THE DRAWINGS

Figure 1:
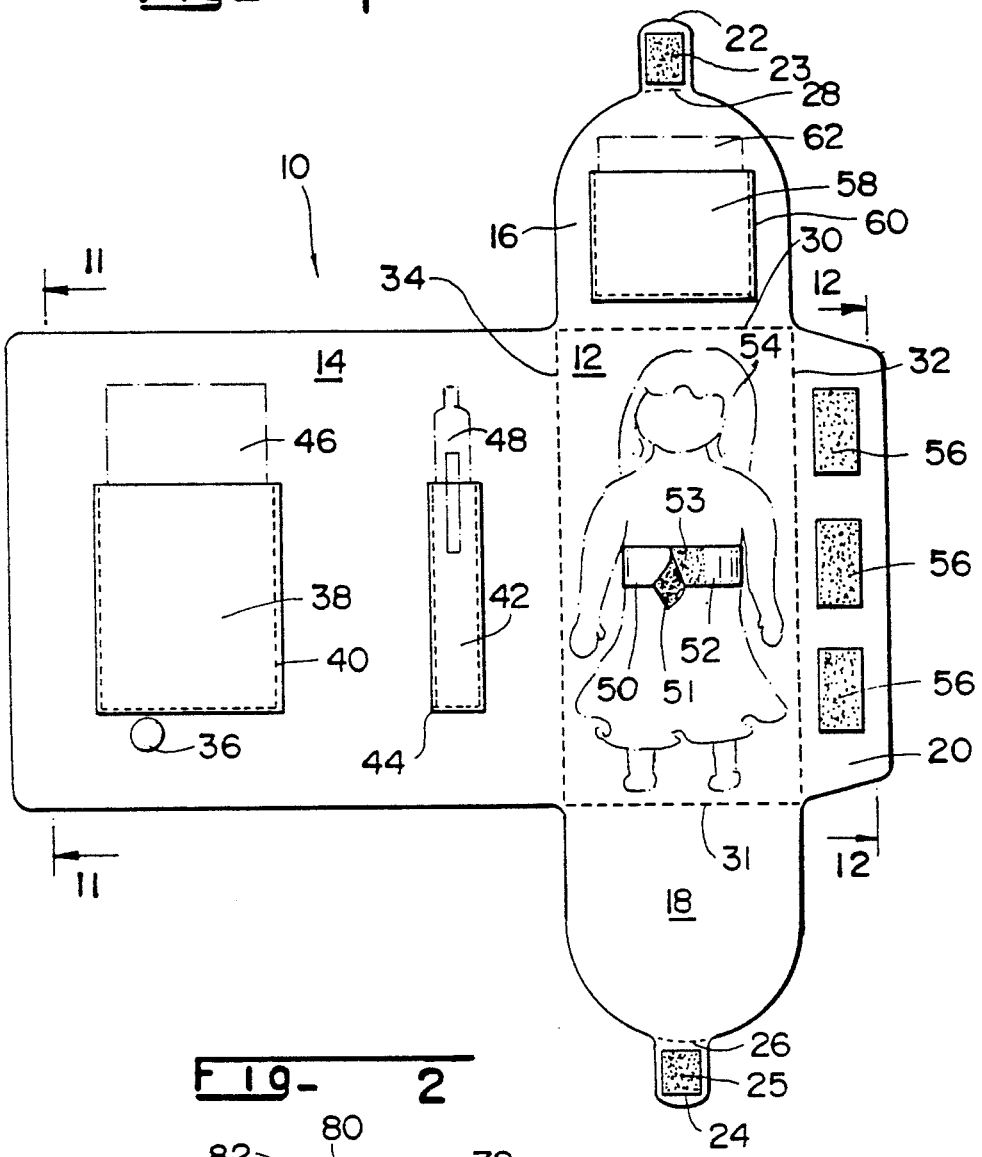
FIG. 1 is a plan view of an unfolded blank, with its inner surface visible, in accordance with a first embodiment of the present invention.

Referring more specifically to the drawings, FIG. 1 is a plan view of a blank 10 used to form a container in accordance with a first embodiment of the present invention. For explanatory purposes, the surface of the blank which forms the inside of the carrier is referred to as the "inner surface", and the surface forming the exterior of the carrier is referred to as the "outer surface" throughout this application.

Figure 2:
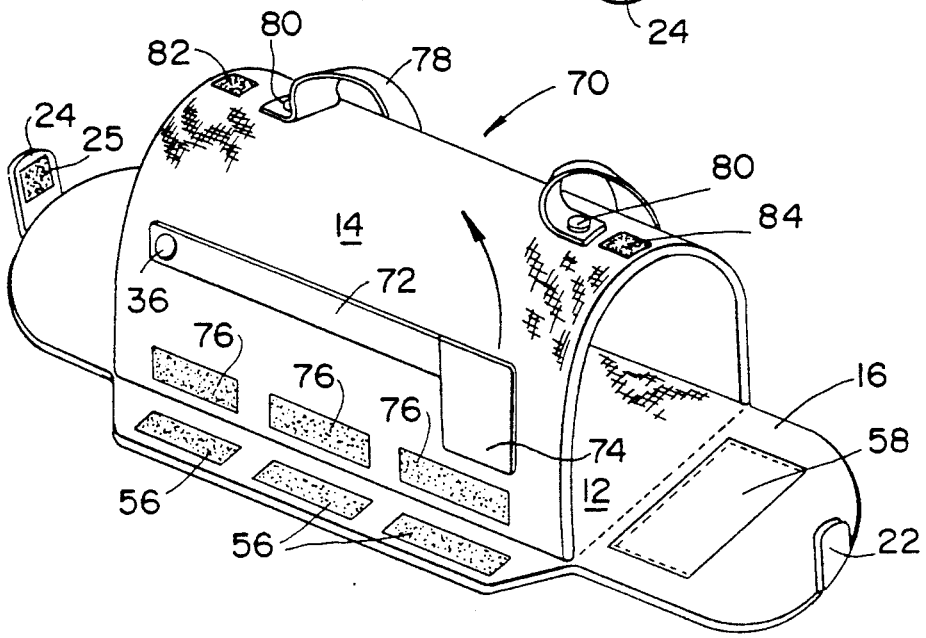
FIG. 2 is a perspective view of the blank of FIG. 1 in partially folded condition.

Blank 10 includes a base panel 12 having a first side edge 34, a second side edge 32, a first end edge 30, and a second end edge 31. First side panel 14, of generally rectangular configuration, is foldably attached along stitching or fold line 34 to base panel 12; and is foldable so as to form a wall or cover overlying base 12, and an article (e.g., a doll) retained thereon, as shown in FIG. 2. In the first embodiment, first and second end panels 16 and 18 are foldably connected to the base panel 12 by folding or stitching lines 30 and 31, respectively. A second side panel 20 is foldably connected to base panel 12 along stitching or fold line 32.

A connecting tab 22 is foldably connected along folding or stitching line 28 to panel 16, and has a Velcro hook or loop surface 23 thereon; and a similar connecting tab 24 is foldably connected along folding or stitching line 26 to second end panel 18, and has Velcro loops or hooks 25 thereon.

Hereafter, reference to "Velcro" or "Velcro patches" will include both loops or hooks, it being clearly understood that opposed mating surfaces must have complementary Velcro loops and hooks in order to be effective as a detachable closure. Further, although Velcro patches are illustrated, it should be understood that other complementary detachable connectors could be used instead, provided that they are secure yet easily detachable.

Base panel 12 is provided to detachably hold a doll 54 thereon, as shown in FIG. 1. The doll is held about its torso by detachable loops 50 and 52, at least a portion of which (shown as loop ends in FIG. 1) includes Velcro patches 51 and 53, respectively. Although the underside of the loops are not shown, either a single loop can be used which would extend through slots or slits (not shown) on the inner surface of panel 12, or separate loops 50 and 52 can be sewn, stitched or otherwise connected to the surface of base panel 12.

The inner (i.e., visible in FIG. 1) surface of panel 20 is provided with a plurality of Velcro attaching surfaces 56, as is also shown in FIG. 1, for a reason to be explained with respect to FIGS. 2 and 3 hereafter.

A plurality of article receiving pockets are also provided on the inner surface of the blank. For example, the inner surface of panel 16 is provided with a fabric or other pocket 58 which is attached to the panel by stitching 60, e.g., as shown in FIG. 1. In this way, a stamp, an envelope, or other paper or thin material, can be inserted into the pocket formed between fabric 58 and the surface of panel 16. Similar pockets 38 and 42 are stitched or otherwise attached to panel 14, by stitching 40, 44, respectively. These pockets as shown are adapted to hold, e.g., paper, advertisements, postcards or other thin material 46, and a pen or pencil 48, respectively, but the pockets could equally well be formed of any configuration to hold other desired articles. The rear side of a suitable connector, e.g., snap fastener, grommet, pivot or rivet 36, is shown as located beneath the bottom of pocket 38, and will be explained in greater detail with respect to FIG. 2.

Before describing the manner in which the blank 10 is folded to form container/carrier 70, as shown in FIGS. 2 and 3, it is noted that the material from which the container is formed can be any material which is lightweight and flexible, yet sufficiently sturdy to resist undue wear and tear. Presently, it is contemplated that the outer and inner surfaces (i.e., both sides) of each of the panels and tabs shown in blank 10 will be formed from a soft, durable fabric which is sewn together along the stitching/folding lines, e.g., along panel edges such as 26, 28 and 34 in FIG. 1. The stitching lines will serve both to reinforce the fabric and to make it easier to fold the fabric along the lines when the container is to be erected. However, because it will likely be necessary to rigidify the container, both to hold the doll and other articles, to form an erect structure, and to withstand damage and deterioration from use, a plurality of corrugated sheets, such as sheet **14*c*, can be inserted into the panels, as shown in FIG. 11. FIG. 11 is a cross section of panel 14 in FIG. 1, but is well representative of the structure of any of the panels of the blanks of the present invention, showing a reinforcing board inserted therein. Thus, while any of the panels and tabs as shown in FIG. 1 could have a reinforcing board of a size and shape generally similar to (although slightly smaller than) the panel inserted between the upper and lower layers of fabric (e.g., fabric layers 14*a* and 14*b* in FIG. 11), it is presently contemplated that fiberboard, pressed cardboard, or corrugated board sheets will be provided as reinforcement for panels 12, 14, 16 and 18 in the embodiment of FIG. 1, with the material used for panel 14 being somewhat more flexible than the sheets used for the other panels, in order to enable it to be more easily folded in an arcuate configuration, as shown in FIGS. 2 and 3. In a preferred embodiment, the sheets are formed of pressed cardboard, except for reinforcing insert 14*c*, which can be a flexible plastic sheet, e.g., called "Plastic Canvas" (made by Darice of Ohio and China), which is preferably utilized because of its flexible, yet durable nature. All of the main panels in the other embodiments (see, e.g., FIGS. 3–9**) are also preferably reinforced by similar sheets. Further, while the noted boards, plastic and fabric are specifically disclosed as the basic materials used to form the container, it is apparent that other materials serving the same purposes as these materials could be used for both the exterior surfaces of the container and the interior reinforcing panels.

FIG. 12 shows two layers **20*a* and 20*b* of fabric which are stitched together to form the flap or tab 20; these layers do not include, as shown in FIG. 1**, any rigidifying structure; however, as noted above, if it is desired to rigidify this panel, (or any of the tabs or panels, for that matter) a reinforcing insert of generally similar (although albeit slightly smaller) shape and size could be inserted into this flap.

After placing desired articles onto the blank, e.g., by insertion into appropriate pocket(s) and/or placement into Velcro loops 50, 52, the blank of FIG. 2 can be folded into a container to be carried by a user such as a child. As shown in FIG. 2, container 70 has been partially erected by folding the side panel or wall 14 over the main panel 12 in a generally arcuate fashion. As can be seen in FIG. 2, when folded in this manner, the exterior surface of panel 14 (which is not visible in FIG. 1) has a plurality of Velcro sections 76 (shown as three in FIG. 2) which are adapted to mate with an equal number of respective Velcro sections 56 on flap or side panel 20, in order to retain the arcuate shape of the panel over the doll 54. As can be seen in FIG. 2, when so folded, the upper panel 14 forms two open ends which are adapted to be closed by folding end panels 16 and 18, respectively, upwardly. In this fashion, it is easy, even for a child, to close or open the carrier, simply by attaching or detaching the Velcro.

In order to simulate a mailbox, a "mail flag" is provided which is pivotably secured by, e.g., a snap fastener (as presently contemplated, including mating complementary snapping elements on the flag 72 and panel 14), grommet, rivet or pivot 36 on the exterior surface of side panel 14. The flag incorporates a generally elongated arm 72 which is perpendicularly directly pivoted to pin 36, and a flag portion 74 which is attached to an opposite end of arm 72. The top of wall or cover 14 also includes Velcro sections 82 and 84 which are adapted to detachably engage, respectively, Velcro sections 25 and 23 on connecting tabs 24 and 22, respectively. Additionally, a flexible handle 78, of conventional construction (e.g., fabric or leather) is provided which is attached by fasteners, e.g., rivets 80, adjacent the midpoint of panel 14 when the panel is folded over the base panel 12.

The fully assembled, ready-to-use container of the first embodiment is shown in its completely erected fashion in FIG. 3. In this Figure, panels 16 and 18 have been folded so that tabs 22 and 24, respectively, have their Velcro portions engage the complementary Velcro portions 82 and 84 on the exterior surface of panel 14. Additionally, flap 20 is shown in a generally vertical position in which Velcro sections 56 have engaged complementary Velcro sections 76. Flag 72 can either be positioned as shown, or pivoted upwardly into a vertical position. Thus, as can be easily seen, the carrier clearly simulates a mailbox, with a pivoting flag which is easily movable by a child.

The second embodiment of the present invention is illustrated in FIGS. 4–7. FIG. 4 illustrates a blank 100 which is foldable into the container or carrier of this embodiment. Blank 100 includes a base panel 102 to which a first side panel 106 is hingedly connected along stitching or fold line 140. A second side panel 104 is attached to the first side panel 106 via stitching or fold line 142, and a third side panel 108 is attached to the second side panel 104 by a stitching or folding line 144. First and second connecting tabs 150 and 152 are hingedly connected by lines 148 and 146, respectively, to third side panel 108. Respective Velcro patches 156 and 154 are positioned on the inner surface (i.e., the surface which is visible in FIG. 4) of tabs 150 and 152, respectively. First and second end panels 112 and 110 are attached to the base panel 102 by folding or stitching lines 136 and 138, respectively. A second, unattached end of second end panel 110 has two tabs 116 and 118 foldably attached to it by folding or stitching lines 132, 134, with respective Velcro patches 122 and 120 located on the inner surface of respective tabs 116 and 118. The first end panel 112 is attached to a single connecting tab 114 via fold or stitching line 126, and has a Velcro patch 124 attached on its inner (i.e., visible) surface. As in FIG. 1, a plurality of pockets are provided on the inner blank surface for receiving various articles. Specifically, end panel 112 includes a pocket 128 attached to the inner fabric surface by stitching 130; a pocket 172 attached by stitching 174 is provided on first side panel 106, with a pen or pencil 176, as shown with dotted lines, being insertable therein. Dual pockets 162 and 166 are attached to second side panel 104, by stitching 164 directly on panel 104, and by stitching 168 on pocket 162, respectively. These two pockets, which are attached to second side panel 104, are adapted to receive flat objects such as paper or envelopes 170, 171. Grommets or rivets 160 and 158 are attached to panels 106 and 108, respectively, and will be discussed in more detail with respect to FIGS. 5–7.

Similarly to the first embodiment, straps or loops 178 and 180 are provided with Velcro portions 179 and 181, respectively, for holding a doll or similar article 182 in a detachable, yet secure, position on base panel 102. The loops 178 and 180 are identical in configuration to loops 50, 52, as described with respect to FIG. 1 above.

FIG. 5 shows the exterior (i.e., reverse) surface of blank 100, which was not illustrated in FIG. 4. In this Figure it is clear that the exterior surface of base panel 104 includes a plurality of Velcro attaching surfaces 194, 196 and 198 which are adapted to engage Velcro surfaces 120, 122 and 124, respectively, when the container is assembled, as shown in FIGS. 6 and 7. Similarly, the exterior surface of base panel 102 has two Velcro attachment surfaces 184 and 186 which are adapted to detachably engage Velcro strips or patches 154 and 156 on tabs 152 and 150, respectively, when the container is assembled.

The exterior surface of first end panel 112 is provided with an additional cloth or fabric (e.g., felt) configuration which is arranged to be simulative of a slot in a mailbox. More particularly, a generally rectangular felt or cloth section 188 is glued or stitched to the exterior surface of panel 112, and includes a central slot 190 which simulates a mailbox slot. The same configuration can be formed by placing an additional narrow strip of material (not shown) under strip 188 and having it be visible through the aperture or slot 190.

Fasteners 158 and 160 are again shown on panels 108 and 106, respectively. These rivets or grommets are attached to retaining loops 161 and 192, respectively, to which a carrying strap (not shown) can be attached to carry the container.

The assembly of the container is best illustrated in FIGS. 6 and 7, respectively. FIG. 6 shows the blank of FIG. 5 in a partially folded condition, with second panel 104 overlying the base panel 102 having a doll retained therein, thereby forming two opposed open ends which are to be closed by first and second end panels 112 and 110, respectively; thus panels 104, 106 and 108 form a wall or cover overlying base 102. As shown in FIG. 6, flaps 150 and 152, each having Velcro thereon, are adapted to detachably engage Velcro patches 184 and 186 on the exterior surface of base panel 102; and ring or eyelet 161 is ready to releasably engage a flexible carrying strap thereon. In this condition, the end panels have not been folded over to engage the front or exterior surface of second side panel 104, as they have been in the completely folded carrier illustrated in FIG. 7. In this Figure, flaps 118 and 116 are shown, having Velcro patches which are attached to Velcro strips or patches 194 and 196 on the exterior surface of side panel 104; and in which flap 114, which is foldably connected to end panel 112, is folded over the front surface of panel 104 so that Velcro patch 124 engages Velcro patch 198 on second side panel 104.

As was the case with respect to the first embodiment of the present invention illustrated in FIGS. 1–3, each of the panels of this blank are preferably provided with relatively sturdy reinforcing sheets of dimensions and sizes slightly smaller than that of each of the fabric panels into which the panels are positioned prior to stitching. For increased flexibility, if desired, e.g., the relatively short flaps or tabs 118, 116, 114 can be provided without such reinforcement. Because there is no need to bend the upper panel in an arcuate fashion as in the embodiment of FIGS. 1–3, the reinforcing material used to reinforce and rigidify panel 104 can be less flexible than that used in panel 14 in the first embodiment of the present invention, e.g., it can be pressed board rather than plastic.

As with the embodiment of FIGS. 1–3, the exterior appearance of the container is intended to simulate that of a mailbox, with the upper fabric 188 and slot 190 serving to simulate the opening at the top of a mailbox of similar overall configuration.

Figure 8:
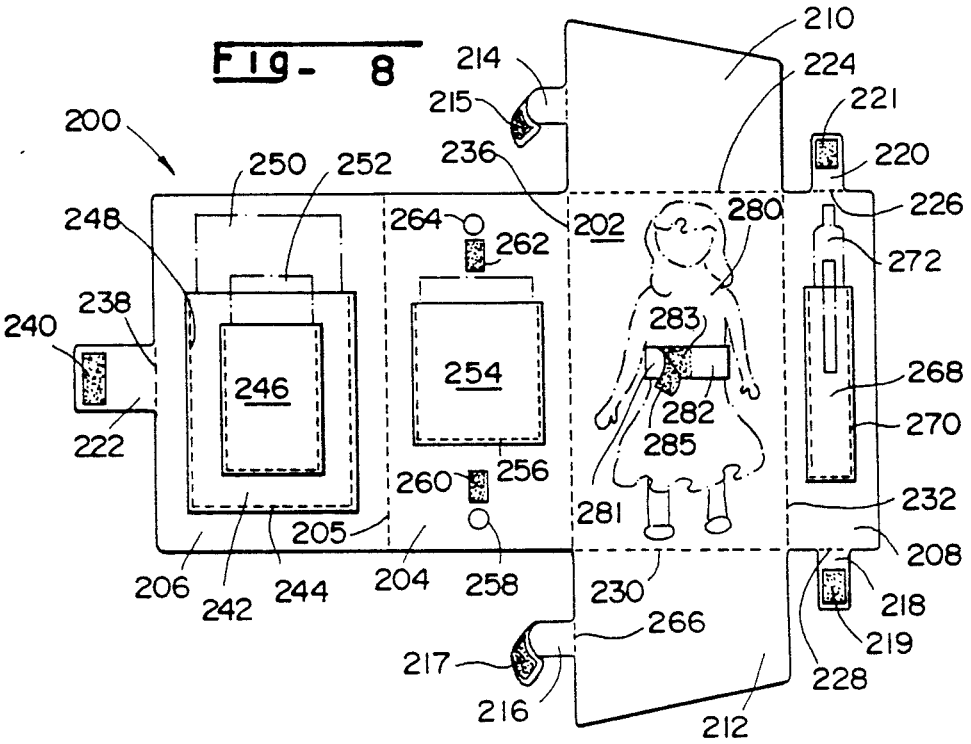
FIG. 8 is a plan view of a blank formed in accordance with a third embodiment of the present invention, with the inner surface of the blank being visible in the Figure.
Figure 9:
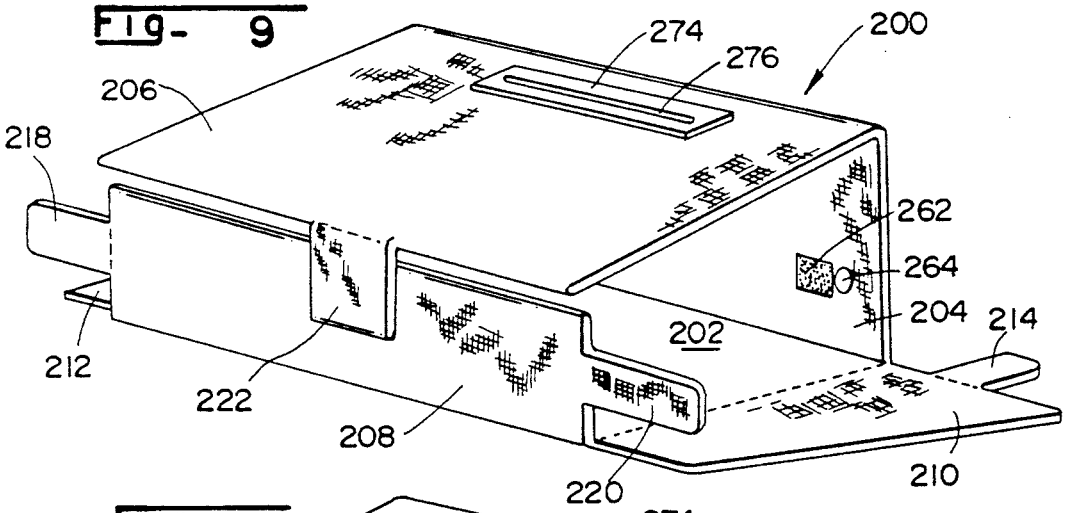
FIG. 9 is a perspective view of the blank of FIG. 3, shown in partially assembled position.
Figure 10:
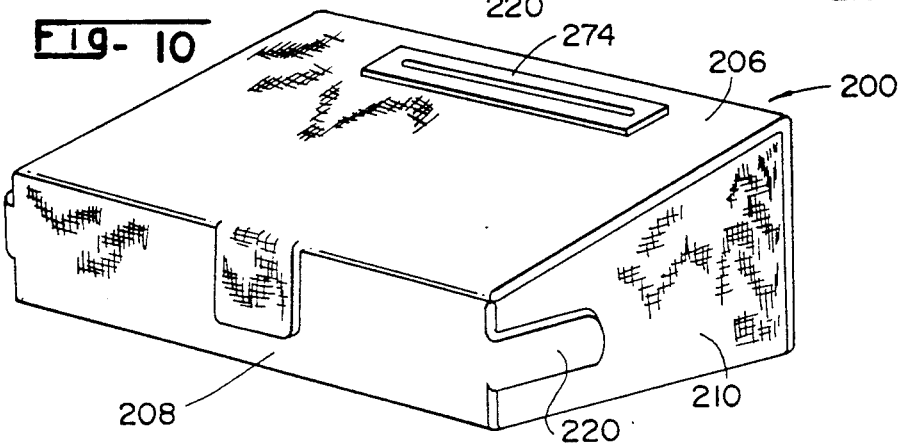
FIG. 10 is a perspective view of a container formed by folding the blank of FIG. 8.

A blank formed in accordance with the third embodiment of the present invention is illustrated in FIG. 8, with the partially folded container illustrated in FIG. 9, and a finished container formed in accordance with this embodiment being illustrated in FIG. 10.

In FIG. 8, blank 200 includes a base panel 202 upon which a doll 280 is adapted to be positioned, with loop straps 282 and 284 having Velcro patches 283 and 285 thereon. Because the configuration of these straps and the manner in which they are attached to the base panel is similar to that shown and described for the embodiment of FIGS. 1–5, they will not be detailed again herein. However, as shown in FIG. 8, these straps or flaps can easily serve to detachably connect a doll or similar FIG. 280 to the inner surface (i.e., the surface illustrated in FIG. 8) of base panel 202.

Attached to panel 202 are first and second end panels 210 and 212, by score or stitching lines 224 and 230, respectively. In turn, connecting flaps 214 and 216 are attached by score or stitching lines 234, 266 to end panels 210, 212. On the exterior surface of the flaps, as shown in FIG. 8, Velcro patches 215 and 217 are provided.

Along first side edge 236 of panel 202, a first side panel 204 is flexibly attached by score or stitching line 236. This panel incorporates a pocket 254 which is attached by stitching 256 or other means to the inner surface of panel 204. Rivets 264 and 258 are provided above and below the pocket, for purposes described hereinafter; and Velcro patches 262 and 260 are provided between pocket 254 and rivets 264 and 258, respectively.

First side panel 204 also includes two grommets or rivets, for reasons described more specifically with respect to FIG. 9. Second side panel 206 is foldably connected to first side panel 204 at score line or stitching line 205, and a closing tab 222 is foldably connected to second side panel 206 by a score or stitching line 238, as shown in FIG. 8. A Velcro patch 240 is attached to the inner surface (i.e., the surface which is visible in FIG. 8) of closure tab 222.

Along the second side edge of panel 202, a third side panel 208 is attached via score or stitching line 232. This panel includes a pocket 268 which is attached to the inner surface of panel 208 by stitches 270, and is adapted to hold a pen or pencil 272. First and second end panels 220 and 218 are attached by score lines 226 and 228, respectively, to opposed first and second ends of the side panel 208; and Velcro patches 220 and 219, respectively, are attached to the inner surfaces of tabs 220 and 218.

In a fashion similar to that illustrated in FIG. 4 with respect to blank 100, panel 206 has two pockets 242 and 246 attached to its inner surface. More particularly, larger pocket 242 is attached by stitching or other means 244 directly to the inner (i.e., visible) surface of panel 206, and a second, smaller pocket 246 is stitched to the upper surface of pocket 242 by stitching 248 or other similar means. Pocket 246 can retain generally flat articles, such as paper or envelopes 252, and pocket 242 can retain similar flat articles 250.

Again, as with the first and second embodiments described in detail above, each of the panels preferably includes an inserted sheet of reinforcing material of generally similar shape and configuration to the panel, which board is inserted before the stitching or sewing of the fabric is effected. If desired, the smaller flaps, e.g., flaps 214, 218, can be formed without such inserts, since it is not as necessary that they be reinforced as are the major panels. The details of the corrugated reinforcement sheets are not discussed in detail again at this part of the specification, since they are identical to those previously discussed.

FIGS. 9 and 10 show the blank of FIG. 8 in partially assembled and fully assembled positions, respectively.

In the partially assembled condition of FIG. 9, the doll retaining base panel 202 is covered by first and second side panels 204 and 206, with flap 206 overlying base 202 and angled with respect to the base and first side panel 204 (see FIG. 10). Although not shown in FIGS. 9 and 10, a flexible handle, similar to the handle used in the embodiments of FIGS. 2 and 6 (not shown in FIG. 6), can be attached to the exterior surface of panel 204, to grommets or rivets 264 and 258, in a known fashion. Velcro patch 215 on flap 214 is adapted to engage the Velcro patch 262 on panel 204, as shown in FIG. 10; similarly, the Velcro on closure tab 220 will engage complementary Velcro on panel 210, which is located so as to underlie tab 220 when closed (see FIG. 10). Similarly, the Velcro patch 219 on tab 218 will engage a patch of Velcro on the exterior surface of second end panel 212 (although the Velcro in panel 212 is not shown in the drawings). Further, Velcro patch 240 on tab 222 engages a Velcro patch along the exterior surface of panel 208 (not shown in the drawings), which directly underlies tab 222 when closed. Further, an additional layer of material 274 of generally rectangular configuration, having a central slot 276, is sewn, glued or otherwise attached to the exterior surface of second side panel 206. The configuration and arrangement of this material can be the same as for fabric 188, as shown in the embodiment of FIGS. 5–7, and is provided for decorative purposes so that the exterior surface of the container will simulate that of a mailbox. Thus, when closed, the front surface of the container looks like a mailbox into which letters could be inserted into the simulated slot 276. As with the embodiment of FIGS. 5–7, the simulated slot could be formed by using a second layer of material of a different color to underly the generally rectangular layer 274.

The blank and carrying cases of the present invention will be particularly useful in selling dolls and promoting pen pals across international boundaries. Specifically, one purpose of forming a container in the form of a simulated mailbox is to promote a concept in which children will purchase dolls from different countries, register with a central registry, and be given a pen pal (e.g., from another country) who has purchased a doll from such other country. Thus, the use of simulated mailbox designs will encourage children to participate in such a registry, and promote the pen pal concept. Not only will a doll of a particular country be provided in the package, but stamps may be provided, e.g., in the relatively small pocket 58 of the embodiment of FIG. 1, as will all of the other necessary materials, such as registration materials and post cards and/or envelopes, e.g., 46, inserted in pocket 58 of the embodiment of FIG. 10, and a pen or pencil 48 inserted within pocket 42. Thus, a child will initially receive all of the materials necessary to register the doll and communicate with other children.

Although the present invention has been described with respect to the specific embodiments and materials discussed above, it is evident that it equally well applies to other modifications and embodiments of the present invention which are within the scope of the claims as appended hereto and as may be amended hereafter.

What is claimed:

1. A blank which is adapted to be folded into a carrier for holding at least one article, said blank comprising:

(a) a base panel having a first side edge, a second side edge, a first end edge, and a second end edge;

(b) means, attached to said base panel, for releasably retaining at least one article on said base panel;

(c) a first, single side panel foldably attached to said base panel, said single side panel being adapted to be folded over said retaining means, said single side panel having one side edge foldably connected to said first side edge of said base panel, and a second, free side edge;

(d) a second side panel having a first side edge and a second side edge, said second side panel first side edge being foldably connected to said second side edge of said base panel, said side panels having complementary means for detachably connecting said side panels to each other when said blank is folded into a container;

(e) a first end panel foldably attached to said first end edge of said base panel, and a second end panel foldably attached to said second end edge of said base panel; and (f) a first closure attached to said first end panel and a second closure attached to said second end panel.

2. A blank in accordance with claim 1, wherein said single side panel has first and second surfaces, and wherein a plurality of article retaining pockets are attached to one of said surfaces of said single side panel.

3. A blank in accordance with claim 1, wherein each of said closures comprises means for detachably connecting one of said end panels to said at least one side panel when said blank is folded into a container.

4. A blank in accordance with claim 1, wherein said retaining means comprises hook and loop fasteners.

5. A blank in accordance with claim 1, wherein each of said panels comprises two layers of cloth stitched to each other.

6. A blank in accordance with claim 5, wherein reinforcing sheets are positioned between said layers of cloth within a plurality of said panels.

7. A blank in accordance with claim 1, wherein each of said end panels has two surfaces, and wherein an article retaining pocket is attached to one surface of at least one of said end panels.

8. A blank in accordance with claim 1, wherein each of said closures comprises a closure tab with hook or loop fasteners for detachably connecting said closures to said first side panel when said blank is folded into a container.

9. A blank which is adapted to be folded into a carrier for holding at least one article, said blank comprising:

(a) a base panel having a first side edge, a second side edge, a first end edge, and a second end edge;

(b) means, attached to said base panel, for releasably retaining at least one article on said base panel;

(c) a first side panel foldably attached to said base panel, said single side panel being adapted to be folded over said retaining means, said single side panel having one side edge foldably connected to said first side edge of said base panel, and a second, free side edge;

(d) a second side panel having a first side edge and a second side edge, said second side panel first side edge being foldably connected to said second side edge of said base panel:

(e) a first end panel foldably attached to said first end edge of said base panel, and a second end panel foldably attached to said second end edge of said base panel; and (f) a first closure tab foldably attached to said first end panel, and a second closure tab foldably attached to said second end panel, each of said closure tabs including means for detachably connecting said closure tabs to said first side panel when said blank is folded into a container.

10. A blank in accordance with claim 9, wherein each of said closure tabs has a hook or loop fastener patch.

11. A container in the shape of a mailbox, said container comprising a carrier for detachably holding at least one article, said container comprising:

(a) a base having an outer surface and an inner surface, a first side edge and a second side edge, said side edges being oppositely disposed with respect to each other, a first end edge, and a second end edge, said first and second end edges being oppositely disposed with respect to each other;

(b) means for detachably retaining at least one article on said inner surface of said base;

(c) a wall extending from said first side edge of said base to said second side edge of said base, said wall overlying said base and defining open first and second ends of the container, said wall comprising a first section which is foldably attached to said first side edge of said base, and which comprises an arcuate cover overlying said base, and a second section which is smaller than said first section and which is foldably attached to said second side edge of said base, said wall sections each including complementary means for detachably connecting said wall sections to each other; and (d) means for closing said open first and second ends.

12. A container in accordance with claim 11, wherein said means for closing said open first and second ends comprises first and second end panels which are foldably connected to said base, and means for detachably connecting said wall to said end panels.

13. A container in accordance with claim 12, wherein said connecting means comprises a tab foldably connected to each end panel.

14. A container in accordance with claim 11, further comprising a generally L-shaped flag which is pivotably attached to said outer surface of said wall, said flag having a elongated arm pivotably connected to said wall, and a perpendicular section attached to one end of said elongated arm.

15. A container in accordance with claim 14, wherein a handle is attached to said wall.

16. A container in accordance with claim 11, wherein said retaining means comprises hook and loop fasteners, and wherein one of said end panels and said wall each includes at least one article retaining pocket respectively attached to inner surfaces of said wall and said one end panel.

17. A container in the shape of a mailbox, said container comprising a carrier for holding at least one article, said container further comprising:

(a) a base having an outer surface and an inner surface, a first side edge, a second side edge, a first end edge, and a second end edge;

(b) means for detachably retaining at least one article on said inner surface of said base;

(c) a wall having an outer surface and an inner surface, said wall extending from said first side edge of said base to said second side edge of said base, said wall comprising a cover overlying said base and defining open first and second ends of the container, said wall being foldably connected to said first side edge of said base, said wall comprising a first section which is foldably attachable to said first side edge of said base and a second section which is smaller than said first section and which is foldably attached to said second side edge of said base;

(d) means for closing said open ends of said cover, said closing means comprising a first end panel and a second end panel, each of said end panels being folded upwardly from said base; and (e) means for connecting said wall to said first and second end panels, said connecting means comprising a first tab foldably connected to said first end panel, and a second tab foldably connected to said second end panel, said first and second tabs being folded over said wall and including means for detachably connecting said end panels to said outer surface of said wall.

18. A container in accordance with claim 17, wherein said wall comprises two sections, a first section attached to said first side edge of said base, and comprising an arcuate cover overlying said base, said second section being foldably attached to said second side edge of said base, each of said wall sections including means for detachably connecting said wall sections to each other.

19. A container in accordance with claim 17, wherein said retaining means comprises a hook and loop fastener loop attached to an inner surface of said base.

20. A container in accordance with claim 17, wherein said means for detachably connecting said wall to said end panels comprises hook and loop fasteners on said first and second tabs.

* * * * *

UNITED STATES PATENT AND TRADEMARK OFFICE

CERTIFICATE OF CORRECTION

PATENT NO. : 5,332,093
DATED : July 26, 1994
INVENTOR(S) : Fred LITTLEPAGE

It is certified that error appears in the above-indentified patent and that said Letters Patent is hereby corrected as shown below:

At column 11, line 62 (claim 9, line 8), change "single" to ---first---.

At column 11, line 63 (claim 9, line 9), change "single" to ---first---.

Signed and Sealed this

Fourteenth Day of March, 1995

*Attest:*

Bruce Lehman

BRUCE LEHMAN

*Attesting Officer*

*Commissioner of Patents and Trademarks*